US010323634B2

(12) United States Patent
Huang

(10) Patent No.: US 10,323,634 B2
(45) **Date of Patent: *Jun. 18, 2019**

(54) HIGH POWER RECIPROCATING PUMP MANIFOLD AND VALVE CARTRIDGES

(71) Applicant: Federal Signal Corporation, Oak Brook, IL (US)

(72) Inventor: Xiaolun Huang, Naperville, IL (US)

(73) Assignee: Federal Signal Corporation, Oak Brook, IL (US)

( * ) Notice: Subject to any disclaimer, the term of this patent is extended or adjusted under 35 U.S.C. 154(b) by 488 days.

This patent is subject to a terminal disclaimer.

(21) Appl. No.: 15/004,296

(22) Filed: Jan. 22, 2016

(65) Prior Publication Data

US 2016/0138585 A1 May 19, 2016

Related U.S. Application Data

(63) Continuation of application No. 14/021,360, filed on Sep. 9, 2013, now Pat. No. 9,382,905.

(51) Int. Cl.

| | |
|---|---|
| ***F04B 1/04*** | (2006.01) |
| ***F04B 39/10*** | (2006.01) |
| ***F04B 53/10*** | (2006.01) |

(52) U.S. Cl.

CPC ..... *F04B 53/10* (2013.01); *F04B 1/0452* (2013.01); *F04B 39/1046* (2013.01); *F04B 53/109* (2013.01); *F04B 39/10* (2013.01); *Y10T 137/6011* (2015.04)

(58) Field of Classification Search

CPC ..... F04B 39/10; F04B 53/10; F04B 53/109; F04B 39/1046; Y10T 137/6011

See application file for complete search history.

(56) References Cited

U.S. PATENT DOCUMENTS

| | | | | |
|---|---|---|---|---|
| 4,551,077 | A | 11/1985 | Pacht | |
| 4,878,815 | A | 11/1989 | Stachowiak | |
| 5,231,323 | A | 7/1993 | New | |
| 5,651,387 | A * | 7/1997 | Thor | F15B 13/043 137/269 |
| 6,231,323 | B1 | 5/2001 | Jezek | |
| 6,241,492 | B1 | 6/2001 | Pacht | |
| 7,121,812 | B2 * | 10/2006 | Forrest | F04B 53/22 417/269 |

* cited by examiner

*Primary Examiner* — Philip E Stimpert

(74) *Attorney, Agent, or Firm* — Merchant & Gould P.C.

(57) ABSTRACT

An improved manifold and valve cartridges suitable for high power (over 600 hp) reciprocating pumps for water blast or jet applications are disclosed. In one aspect, the disclosed valve cartridges are compact and mounted axially along a seat member that has a central bore in addition to suction and discharge seats. The seat member can also be provided a plurality of radially arranged bores for allowing suction flow to the pump. A spool valve assembly can be mounted through the seat member bore, and can include a valve spool, a spherical suction valve member, a compression spring, and compression-locked rings. The spool valve can include a closed flanged end that engages with the seat member discharge seat. In operation, the compression spring continuously pushes the spool valve closed flanged end against the discharge seat and pushes the suction valve member against the suction seat to retain a normally closed position.

15 Claims, 7 Drawing Sheets

HIGH POWER RECIPROCATING PUMP MANIFOLD AND VALVE CARTRIDGES

CROSS REFERENCE TO RELATED APPLICATION

This application is a continuation of application Ser. No. 14/021,360, filed Sep. 9, 2013, which application is incorporated herein by reference in its entirety.

TECHNICAL FIELD

This invention relates to high power reciprocating pumps of the type used in high flow and high pressure water blast and jet applications, and more particularly to an improved manifold and valve cartridges for lower ownership cost.

BACKGROUND

Generally, an industrial reciprocating pump consists of three or five crankshaft-driven plungers to compress and eject fluid. A manifold is also often used to cap the open ends of the multiple plunger boxes and manage the flow during operation based on suction or discharge strokes. Traditionally, manifold pockets are provided in the manifold that communicate with the plunger chamber. Within the pockets, two individual check valves are provided to serve the suction and discharge functions, respectively. Such an arrangement can be cumbersome, as many parts are involved that can be difficult to service. Other systems involving axially combined two-valve cartridges have been developed as well.

However, as the water blast and jet industry demands higher and higher power on pumps, many new challenges have arisen. For example, high dynamic loads associated with such increases can have a significant effect on durability. Additionally, high flow requires either more plungers or larger plungers, but the former will lead to more parts and wider power frame structure while the latter will result in larger plungers and valves with ultimately higher dynamic loads. Thus improvements in valve cartridges and manifolds are desired.

SUMMARY

Accordingly an objective of the concepts provided in this disclosure is to improve the valve cartridge on dynamic loads, to enable easier fabrication and to provide a more durable configuration. Another objective is to provide a manifold to house different sizes of valve cartridges for higher flow or higher pressure from the demand of higher power, and particularly for pumps meeting or exceeding 600 horsepower. In accord with the above, the present disclosure is especially directed to an improved valve cartridge received inside the manifold of a high pressure reciprocating pump, as already illustrated generally in U.S. Pat. No. 5,231,323, the entirety of which is incorporated by reference herein. In one aspect, the valve cartridge of the disclosure is disposed between the manifold block and an adjacent plunger box and can be easily removed and replaced when folding down the manifold block.

The valve cartridge of the present disclosure is compact and constructed around a seat member. The seat member has a central bore and two ends that are used as suction and discharge seats, respectively. The front-end seating face is for suction and is provided with a plurality of radially arranged bores or holes that provide fluid communication between an annular suction chamber and the plunger chamber. As presented, a spool valve assembly is mounted through the bore. It includes a valve spool, a spherically-shaped suction valve member, a compression spring and compression-locked rings to secure the spring on the spool. The compression spring will continuously push the two valve members against the seat member mating seat surfaces to maintain a normally closed position. In one aspect, the valve spool is T-shaped, where the enlarged diameter end has tapered seat surface and the spool body has a central bore and a plurality of lateral slots extending through the wall for fluid communication. In a compression stroke, the pressurized water from the plunger chamber pushes on the closed end of the valve spool, forcing the spring compressed and letting the valve open. Then water will flow through the lateral slots at the discharge end of the spool into the discharge passage of the manifold block.

In one aspect, a suction valve is placed at the end of the seat member facing the plunger box and inserted on the valve spool. A compression spring is then installed between the open end of the spool and the suction valve, so that the suction valve normally closes the plurality of suction holes in the seat member. In a suction stroke, the supply water, communicating through the plurality of suction holes, acts on the suction valve member and causes the valve to retreat by forcing the spring compressed. As a result, a portion of the supply water flows in from the spool inner bore through the adjacent plurality of slots in the spool while another portion flows in from the outer edges of the member. Such a two-way flow pattern not only reduces flow restriction but also improves reliability. Additionally, using a spherical surface on the suction valve seat can improve sealing and tolerance to dynamic loading.

The disclosed valve cartridge is compact, lightweight, and has lower flow restrictions than typical known systems, and also provides an opportunity to increased size and capacity with lower dynamic damage. Notably, another benefit of the disclosed designs is an increased flow without adding more plungers.

Another feature of the disclosed designs is that the outside cylindrical profile of the seat member is generally stepped and sealed by radial sealing means, such as O-ring seals. Accordingly a manifold is made with multiple-stepped bore pockets. The combination leads to a single manifold for housing serial sizes of valve cartridges, resulting in fewer parts to own, carry and operate. A further feature is to provide a pilot passage in the manifold so that whenever changes a different size of valve cartridge will be able to operate a pressure.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the examples disclosed herein are based.

BRIEF DESCRIPTION OF THE DRAWINGS

Non-limiting and non-exhaustive embodiments are described with reference to the following s, which are not necessarily drawn to scale, wherein like reference numerals refer to like parts throughout the various views unless otherwise specified.

DETAILED DESCRIPTION

Figure 1:
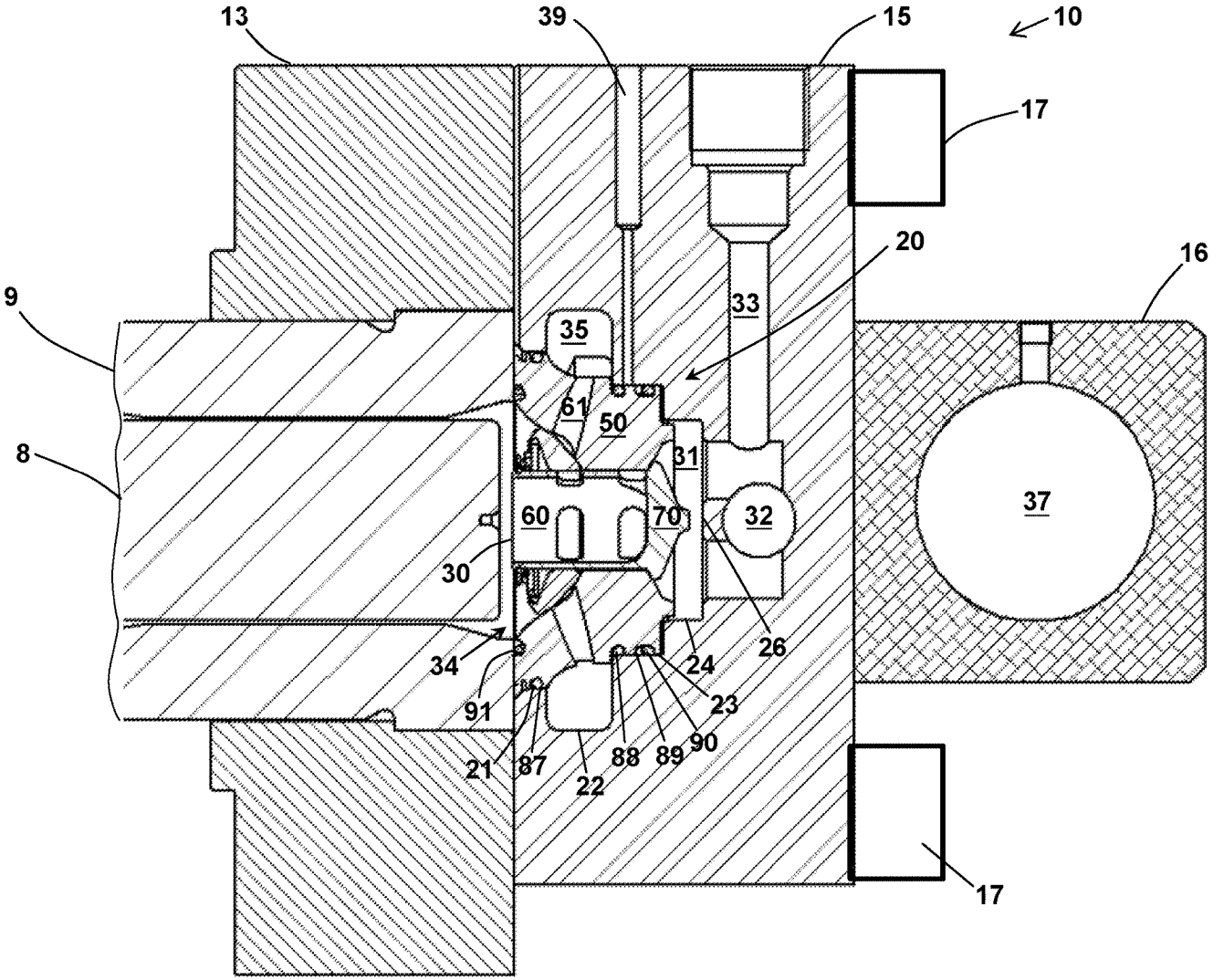
FIG. 1 is a fragmentary cross-sectional view through a high pressure reciprocating pump showing the valve cartridge, manifold and adjacent plunger box having features that are examples of aspects in accordance with the principles of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Manifold Design

Referring to FIG. 1, a fluid end 10 of a high pressure reciprocating pump is shown as including a mounting block 13 for housing plunger box 9 and a manifold block 15 bolted to the pump fluid end 10 by fasteners 17. As shown, a plunger 8 reciprocally slides inside the plunger box 9 to create suction and compression strokes. In one aspect, the manifold block 15 has one or more pockets 18, each of which defines a plurality of differently sized, stepped bores 21, 22, 23, and 24 to accommodate the installation of variously sized and configured valve cartridges 20, 20A within the same manifold 15. The stepped bores 21, 22, 23, and 24 can also provide sealing surfaces with seals mounted on the valve cartridges 20, 20A.

Figure 6:
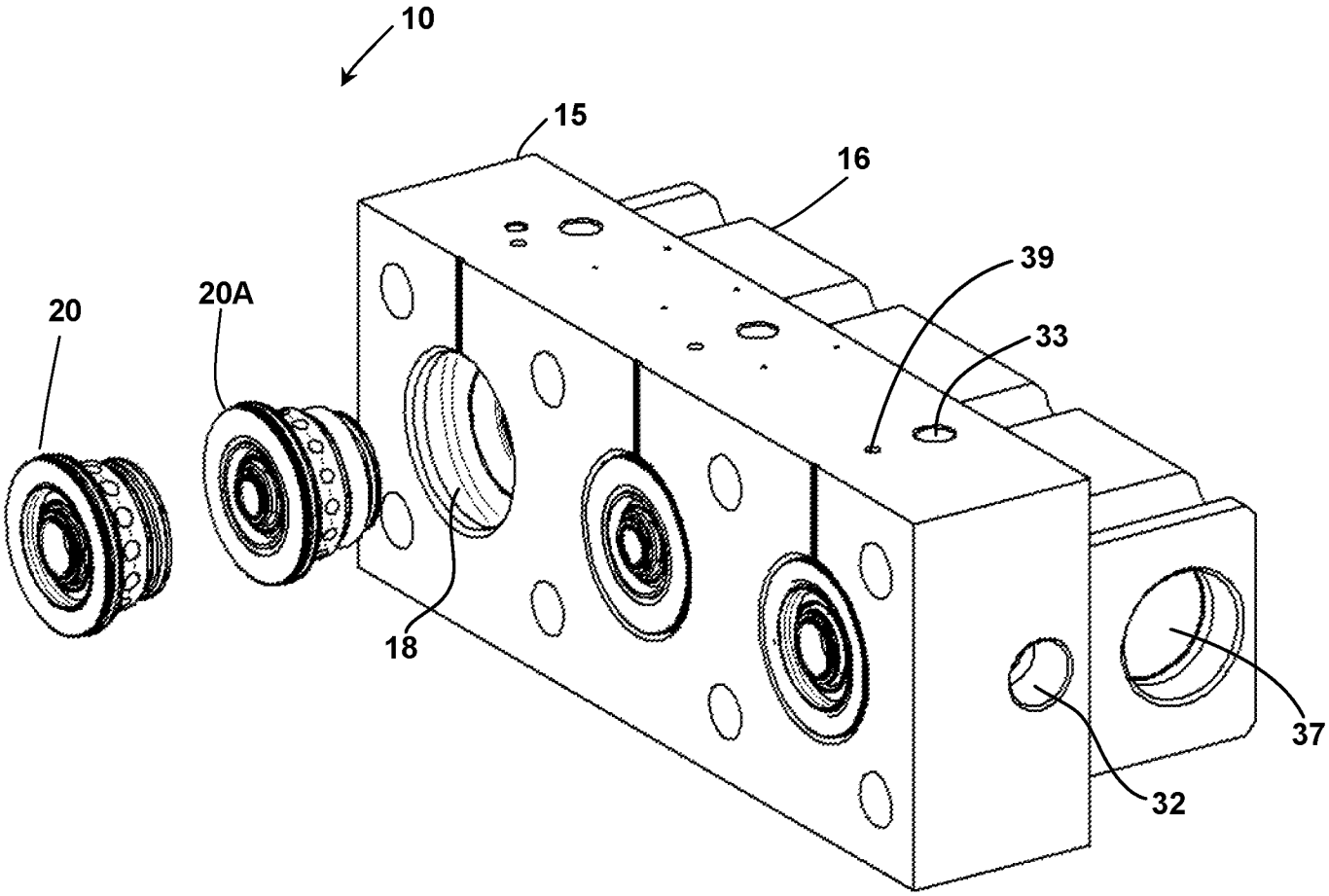
FIG. 6 is a perspective view of the manifold of FIG. 1 showing that the cartridges of FIG. 1 and FIG. 5 can be installed in the same manifold pocket.

With reference to FIG. 6, it can be seen that manifold block 15 is provided with three pockets 18 and three valve cartridges 20 (or 20A), although it should be understood that more or fewer pockets 18 may be provided without departing from the concepts presented herein. For further details of fluid end 10, reference is made to the aforementioned U.S. Pat. No. 6,231,323, the entirety of which is incorporated by reference herein.

Figure 2:
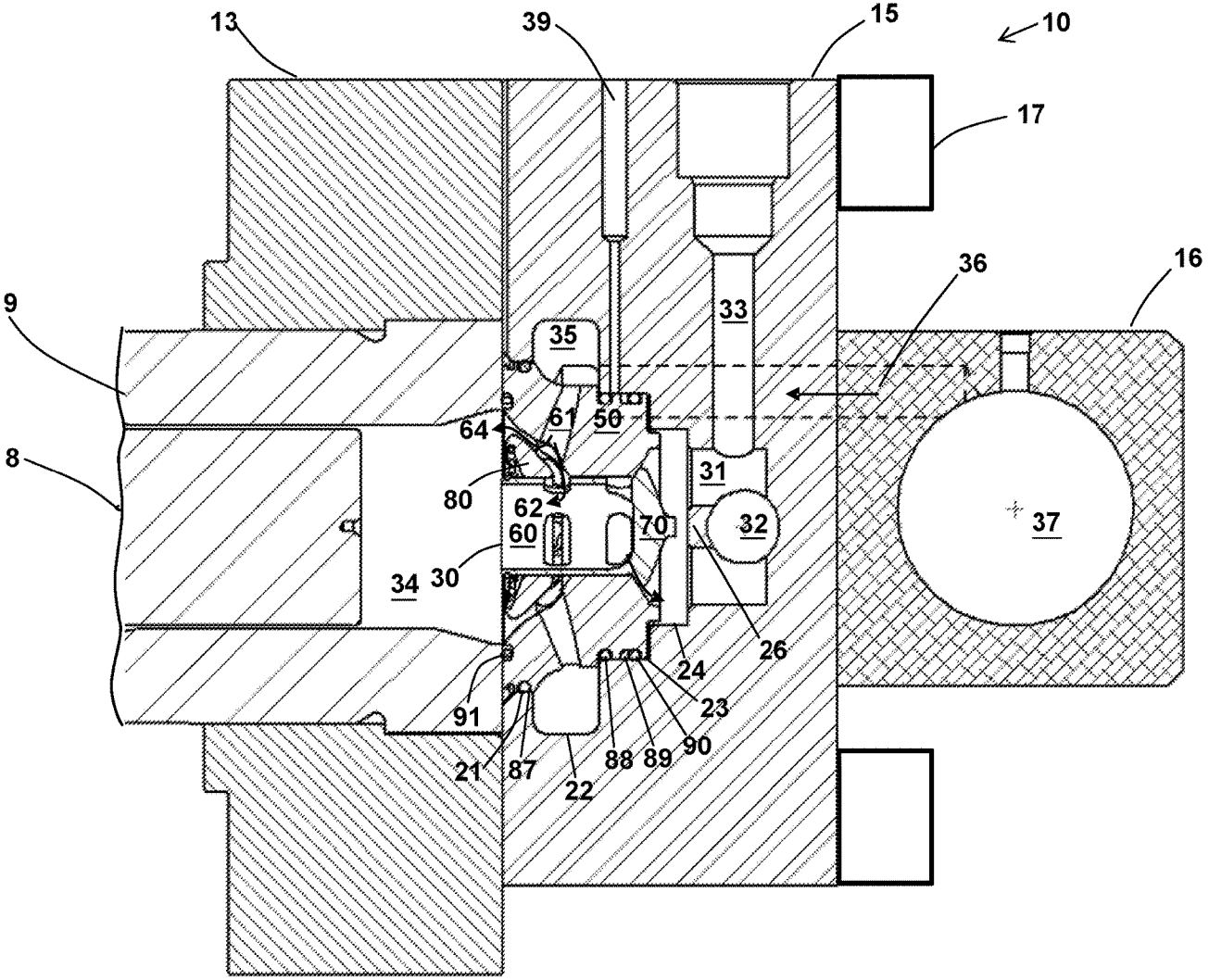
FIG. 2 is a cross-sectional view of valve cartridge, manifold and adjacent plunger box of FIG. 1 wherein the components are in a suction mode of operation.

In the embodiment presented, the manifold block 15 is shown as being operably connected to a suction port manifold 16 from which fluid can be drawn into the pump (e.g. plunger 8, plunger box 9) through the manifold block 15. With reference to FIG. 2, suction fluid flows from a laterally extending suction fluid port 37 in the suction port manifold 16, through a passageway 36 in the manifold block 15, and into an annular chamber 35 defined by bore 22. As configured, the valve cartridge 20 controls the flow of fluid from the annular chamber 35 into the plunger box 9. It is noted that the suction port manifold 16 may be made from a variety of materials, such as aluminum or an engineered plastic or polymer. The materials for the manifold block 15 and the suction port manifold 16 may be the same or different materials.

The manifold block 15 is also shown as including a laterally extending discharge port 32 configured as a through hole in the manifold block 15. The discharge port 32 provides a common exit passageway for pressurized fluid from the pump through each pocket 18. With reference to FIG. 1, discharge fluid flows from an annular discharge chamber 31 defined by bore 24 to the discharge port 32 via an internal passageway 26. In one embodiment, passageway 26 is configured as a plurality of small holes. As configured, the valve cartridge 20 controls the flow of fluid from the plunger box 9 to the annular chamber 31.

Figure 7:
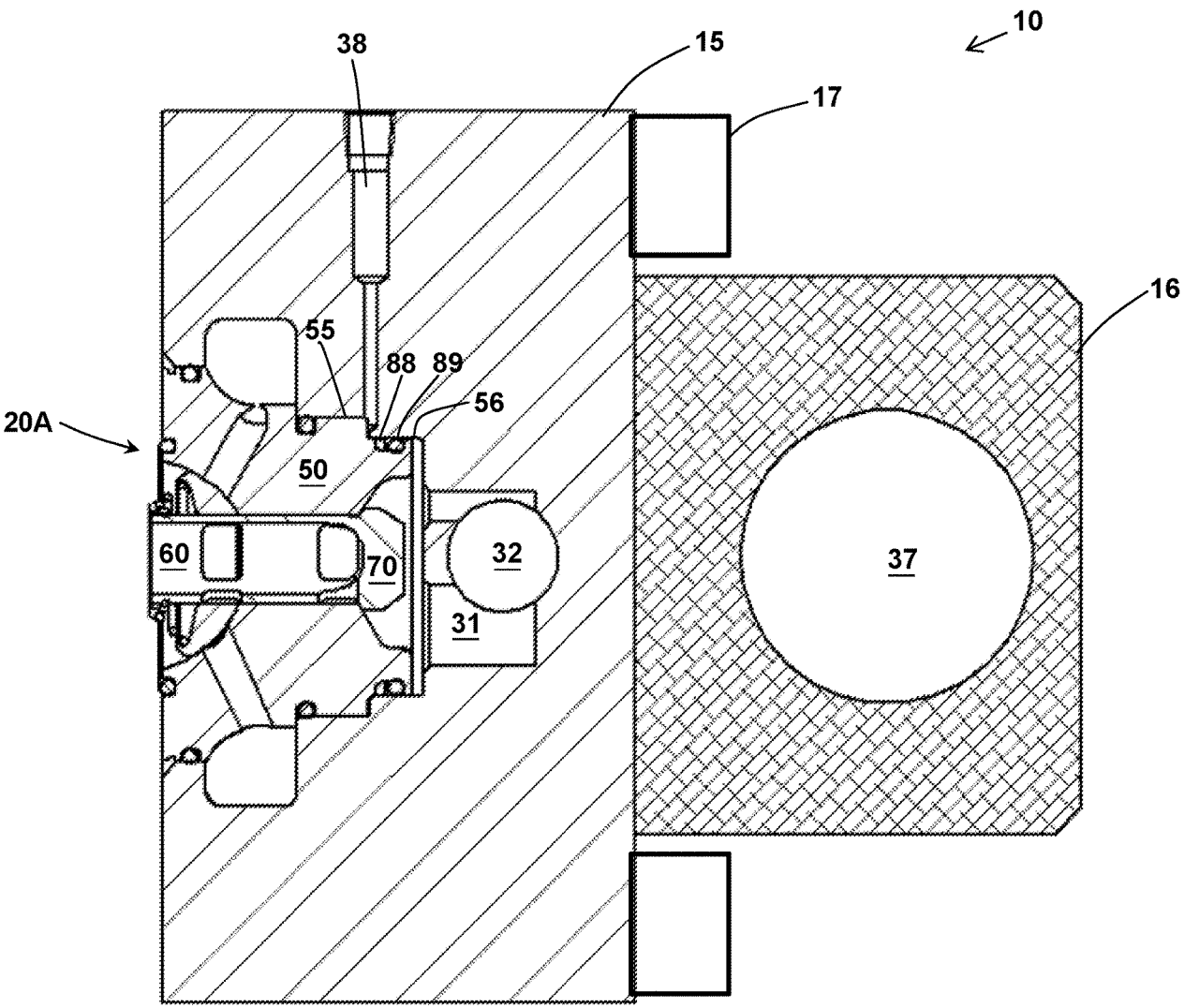
FIG. 7 is a cross-sectional view of manifold and adjacent plunger box of FIG. 1 with the second valve cartridge of FIG. 5 installed in the manifold.

Adjacent to the discharge chamber 31, the manifold block 15 is provided with a passageway 33 that may be used for gauging or for by-pass valve mounting, as well as a local pulsation dumper. The manifold block 15 is also provided with a passageway 39 that functions as a weep hole to indicate if there is leakage on the discharge or suction seals of the valve cartridge 20. The manifold block 15 can also be provided with a built-in pilot pressure passage 38, as shown at FIG. 7, for automatically sensing the change on different sizes of cartridges 20, 20A.

As discussed previously, fasteners 17, which may be machine bolts or screws, are used to clamp the manifold block 15 to the mounting block 13. Due to high pressure, especially high pulsation forces acting on the valve cartridge 20, it is preferable to have a self-clamping feature (discussed later) designed into the manifold 15 so that there is less demand on pre-tension and fatigue life to the fasteners 17.

Valve Cartridge Design

Figure 4:
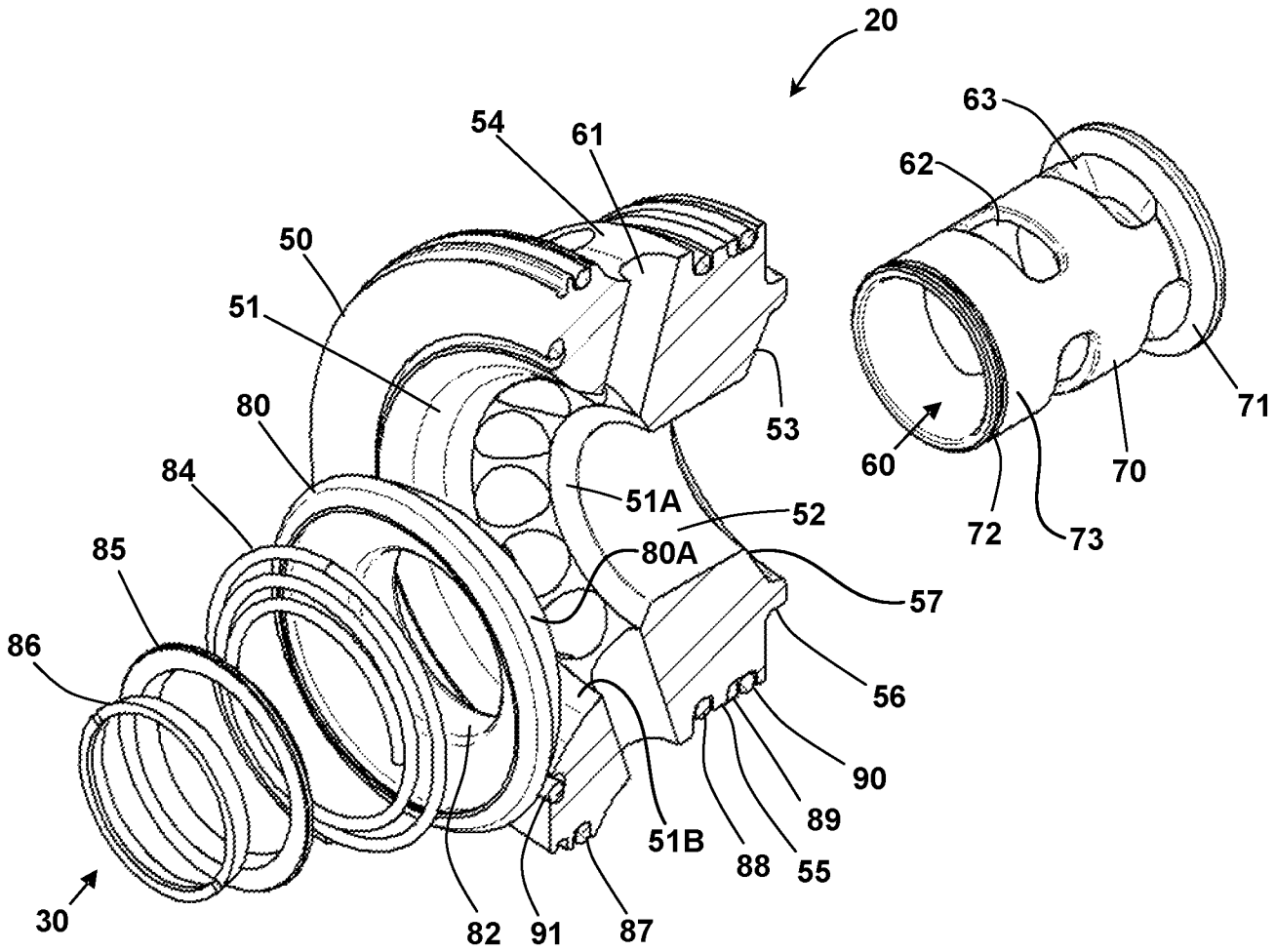
FIG. 4 is a cross-sectional and exploded perspective view of the valve cartridge shown in FIG. 1.
Figure 5:
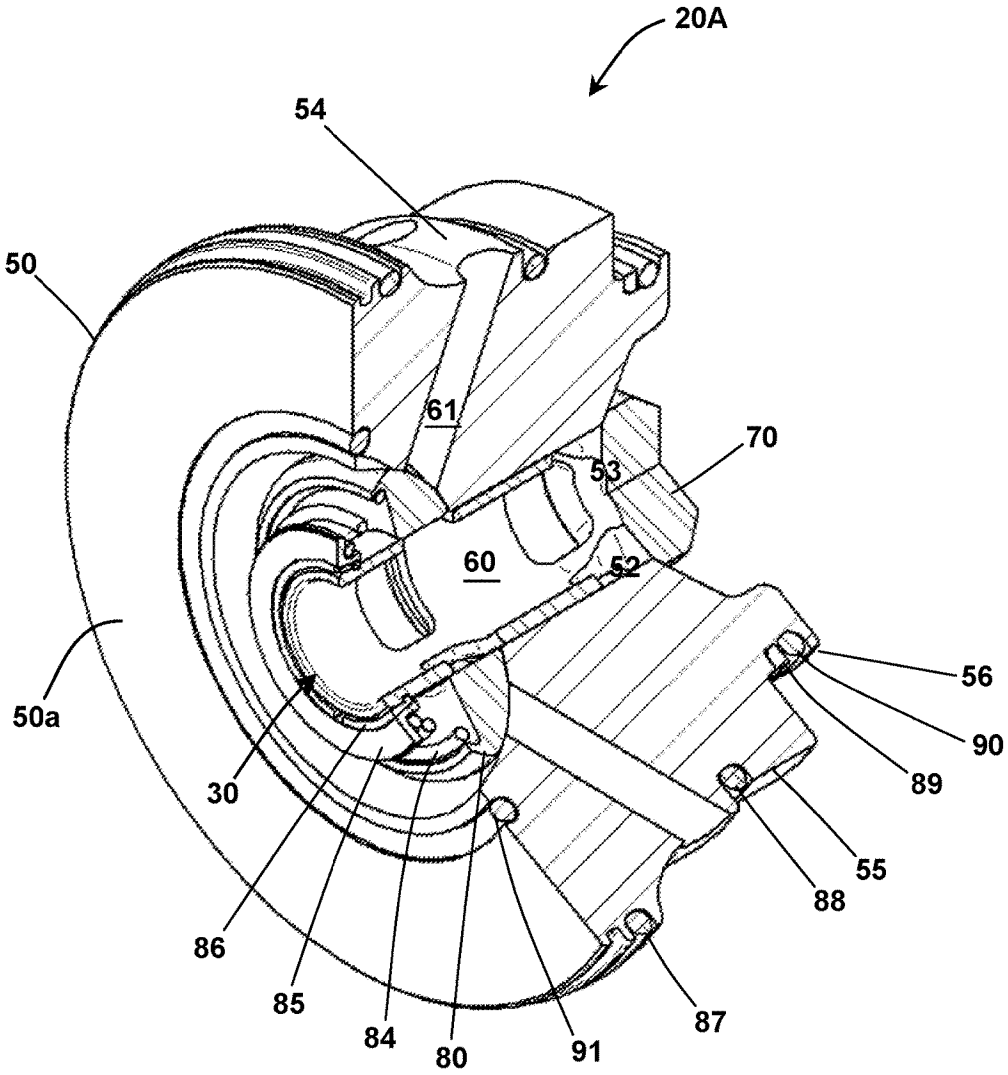
FIG. 5 is a cross-sectional perspective view of a second valve cartridge usable in the manifold of FIG. 1, but that is smaller than the valve cartridge shown in FIG. 1.

Referring to the perspective view provided at FIGS. 4 and 5, the valve cartridge 20 can be seen in further detail. Additionally, a differently sized valve cartridge 20A is shown at FIGS. 5 and 7. As many of the features of the smaller cartridge 20A are shared with the cartridge 20, it should be understood that the description for the cartridge 20 is applicable and fully incorporated by reference into the description for the smaller cartridge 20A.

In one aspect, the valve cartridge 20 includes a seat member 50 having a central bore 52 that functions as the main body of the valve cartridge 20. As shown, the seat member 50 is provided with a plurality of equally radially spaced bores 61 extending from an outside annular face 54 of the seat member 50 to a suction seat surface 51 of the seat member 50. The suction seat surface 51 can be shaped as a round groove and divided into portions, for example an inner band 51A and outer band 51B. A round groove is preferable to connect the bores 61 on the suction seat surface 51 to improve flow restriction and structural stress concentration. In addition, it is preferable that the seat surface 51 has a spherical-shape for better sealing and higher impact resistance. A spherical-shaped seat also gives rotational freedom on the suction valve, which makes the suction valve more tolerant to high flow situations.

The outside profile of the seat member 50 can be stepped and provided with seals, for example radial O-ring seals or other types of seals. In the embodiment shown, the outside annular surface 54 is formed as a first step having a first seal 87. A second step 55 is also provided on the opposite side of the radially spaced bores 61, and is provided with a second seal 88. Taken together, the first and second seals 87, 88 seal the annular suction chamber 35. The second step 55 is also provided with an O-ring 90 along with a back-up ring 89 that together are configured to seal high pressure from the discharge chamber 31. The seat member 50 is also provided with a third step 56 which may also be provided with a seal.

Additionally, as the seat member 50 and the pocket cavity 18 in the manifold 15 each have a stepped profile, the configuration allows the use of different sizes of cartridges 20 by sealing at different step shoulders. For example, a comparison of FIGS. 4 and 5 illustrates that, for bigger cartridges 20, which are useful for higher flow applications, the high pressure seals 89 and 90 are placed at shoulder 55. Alternatively, for smaller cartridges 20A, which are useful for higher pressure applications, the back-up ring 89 and seal 90 are located at shoulder 56.

The seat member 50 may also be provided with a face seal 91 for providing a seal between the plunger box 9 and the front face 50*a* of the seat member 50. As mentioned previously, a self-clamping feature can be provided that is effective in reducing the leak tendency on the face seal 91. As presented herein, the self-clamping feature is ensured by designing the diameter of the face seal 91, shown as an O-ring, slightly smaller than the diameter of the discharge chamber 31, preferably at a ratio of about 1:1.05 to about 1:1.2, to cause a bias pressure difference. It is noted that the diameter of the face seal 91 is at least equal to the interior diameter of the plunger box 9, and thus the diameter of the discharge chamber 31 is greater than the internal diameter of the plunger box. It is also noted that for differently sized valve cartridges (e.g. 20A), the diameter of face seal 91 would change according to the aforementioned ratios.

The valve cartridge 20 is also shown as being provided with a spool valve assembly 30 that is mounted through the bore 52 of the seat member 50. In the exemplary embodiment shown, the spool valve assembly 30 includes a valve spool 70, a suction valve member 80, a compression spring 84 and compression-locked rings 85, 86 which secure the spring 84 onto the spool 70. As explained in further detail later, the assembled spool valve assembly 30 and seat member 50 operate to allow fluid from the suction port manifold 16 to enter the plunger box 9 and to block fluid from exiting the plunger box 9 via the discharge port 32 when the plunger causes a vacuum in the plunger box. Likewise, the assembled spool valve assembly 30 and seat member 50 operate to block fluid from entering the plunger box 9 via the suction port manifold 16 and to allow fluid to exit the plunger box 9 via the discharge port 32 when the plunger 8 causes a compressive force in the plunger box 9.

As presented, the valve spool 70 is provided as a generally cylindrical tube with a circumferential wall 73 extending between an open end 72 and a closed flanged end 71. The open end 72 can be provided with a groove or threads to engage with the compression-locked rings 85, 86 while the closed flanged end 71 is configured to seat against a discharge seat surface 57 on the seat member 50. Taken together, the valve spool closed flanged end 71 and the seat member 50 form a discharge valve. In one aspect, the valve spool 70 defines an interior volume 60 and is provided a first set of radially spaced slots 62 and a second set of radially spaced slots 63 providing passageways into the interior volume 60.

The suction valve member 80 is preferably provided with a spherical seat surface 80A and has a bore 82 that allows the suction valve member 80 to freely slide along the valve spool 70. In one aspect, the seat surface 80A is complementarily shaped to match the contour of the seat surface 51 to form a suction valve, wherein the suction valve member 80 is able to block fluid flow from passing through the bores 61. The suction valve member 80 may be retained by a conical compression spring 84, which is retained on the open end the valve spool 70 by the retainer 85 and secured by a securing member 86, for example a C-shaped or preferably 2-piece split lock ring with a tapered jamming interface. The securing member 86 may also be a single O-ring shaped snap ring.

In operation, the compression spring 84 consistently acts on the suction valve member 80 towards a closed position against the seat member 50. This same acting force also simultaneously urges the closed flanged end 71 of the valve spool 70 towards a closed position against the seat surface 57 of the seat member 51. Accordingly, for either the suction valve member 80 or the valve spool 70 to become opened, a pressure or vacuum fluid force created by the plunger 8 must first overcome the biasing force of the compression spring 84. Necessarily, only one of the suction or discharge valves of the valve cartridge 20 can be acted on to open at any given time based on whether a vacuum or pressure condition exists in the plunger chamber 34

With reference to FIG. 7, it can be highly desirable to have a safety lock or control feature when swapping the vale cartridges 20, 20A due to a possible pressure rating limitations of the cartridges 20, 20A. FIG. 7 illustrates such a pilot pressure port 38, which can be used to automatically sense the pressure change. For example, when using a bigger cartridge 20, back-up ring 89 and seal 90 are on the shoulder bore 55, pressurized fluid will reach port 38. On the hand, if a smaller cartridge 20A is used, as is shown in FIG. 7, the back-up ring 89 and seal 90 will be on shoulder 56, and thus the pressure will not reach port 38. Accordingly, the pressure at port 38 can be utilized to detect the installation of a differently sized valve cartridge which can then enable the pump or system to implement a safety lock or control feature.

Operation

With reference to FIG. 2, the valve cartridge 20 is in a suction position during the suction stroke of the plunger 8. As plunger 8 retreats in a direction away from the valve cartridge 20, the plunger chamber 34 defined by the plunger box 9 and plunger 8 turns into a vacuum condition. As the vacuum condition increases and overcomes the compression force of the spring 84, the suction valve member 80 is moved to an open position away from the suction seat surface 51 to open suction passage 61. Consequently, fluid from the suction port 37 flows into annular chamber 35 via passage 36, and then through suction passage 61 and into the plunger chamber 34. This flow occurs in two ways. First, an inward flow through the adjacent slots 62 on the valve spool bore 30 is developed. Second, an outward flow 64 over the outer circumference of the suction valve member 80 is developed. During the suction stroke, the compression spring 84 retains the valve spool flanged closed end 71 in a closed seated position on the discharge seat surface 57 such that fluid cannot be drawn from the discharge port 32 and into the plunger chamber 34.

Figure 3:
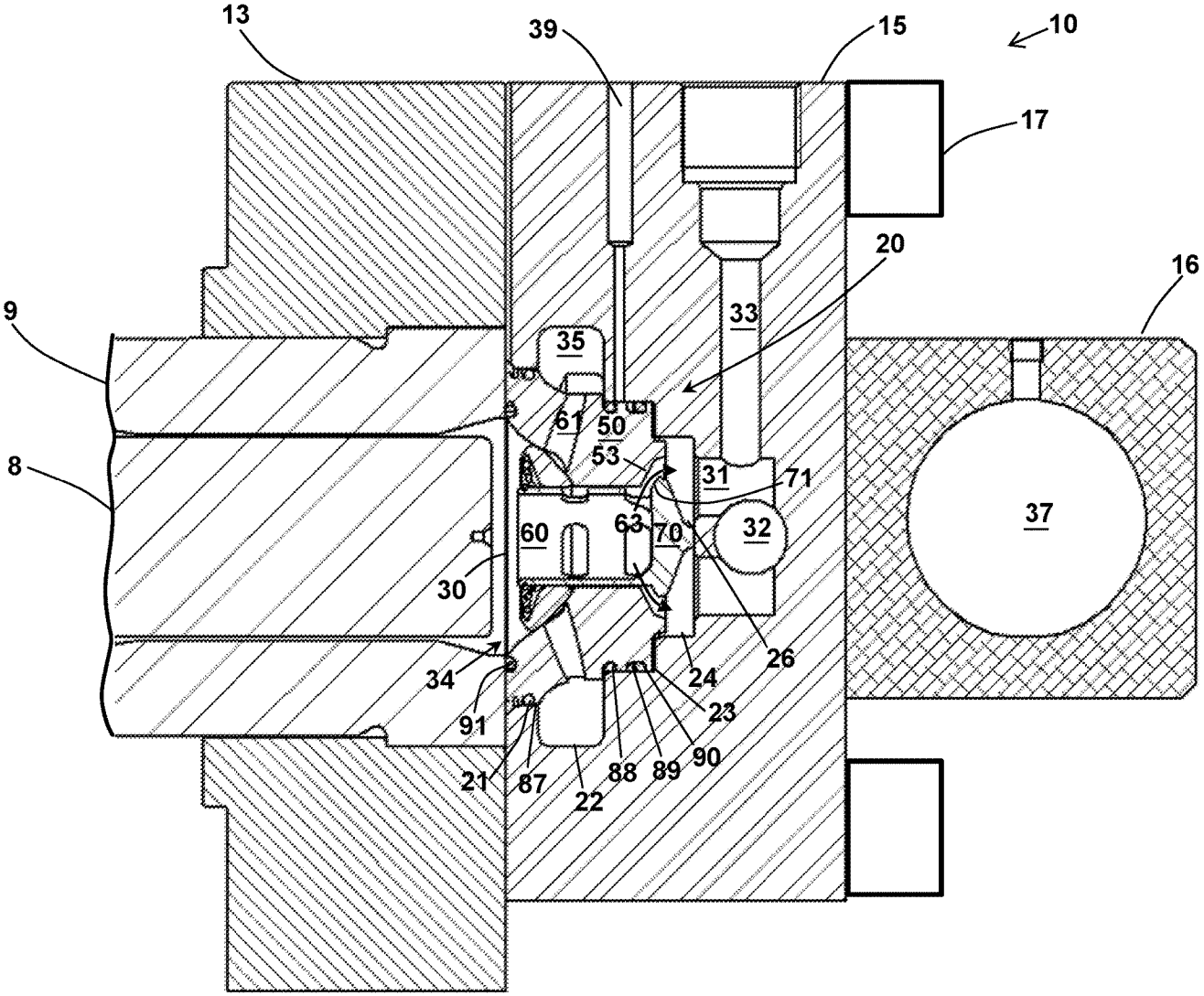
FIG. 3 is a cross-sectional view of valve cartridge, manifold and adjacent plunger box of FIG. 1 wherein the components are in a discharge mode of operation.

During a compression stroke of plunger 8, as shown in FIG. 3, the plunger 8 is moving towards the manifold 15. In this mode of operation, the compression spring 84 forces the suction valve member 80 closed to block passages 61. Additionally, as the pressurized fluid exceeds the spring force of the spring 84, the fluid acts on the closed end 71 of valve spool to unseat the closed end 71 from the seat surface 57 on the seat member 50. Consequently, the discharge valve will open and rest on bottom face 26 of manifold block 15 at which point the pressurized fluid flows through bore 33, lateral slots 63 and seat 71 into discharge chamber 31, and then discharge port 32.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the disclosure.

What is claimed is:

1. A reciprocating fluid pump comprising:

(a) a manifold block;

(b) a plunger box fitting against the manifold block;

(c) a reciprocating plunger mounted within the plunger box; and (d) a first valve cartridge positioned between the manifold and the plunger box;

(e) wherein the manifold block has a pocket for receiving the first valve cartridge, the pocket being defined by a plurality of bores having different diameters from each other, the pocket defining a first passageway from the plunger box to a discharge port in the manifold block;

(f) wherein the manifold has a pilot pressure passage extending into the first passageway through one of the plurality of bores to automatically enable sensing of a valve cartridge configuration;

(g) wherein the plurality of bores includes a first bore, a second bore, and a third bore, wherein the second bore is between the first and third bores, and wherein the pilot pressure passage extends into the first passageway through the second bore.

2. The reciprocating fluid pump of claim 1, wherein the first valve cartridge includes a first step and a first seal for engaging with the first bore, a second step and a second seal for engaging with the second bore, and a third step and a third seal for engaging with the third bore, wherein when the first valve cartridge is installed in the pocket, the third seal prevents pressurized fluid flow from passing between the discharge port and the pilot pressure passage.

3. The reciprocating fluid pump of claim 2, further comprising a second valve cartridge receivable within the pocket, wherein when the second valve cartridge is installed in the pocket, the pilot pressure passage and discharge port are in fluid communication with each other.

4. The reciprocating fluid pump of claim 1, wherein the manifold block includes a plurality of reciprocating plungers, a plurality of valve cartridges, and a plurality of pockets for receiving the plurality of valve cartridges.

5. The reciprocating fluid pump of claim 1, wherein the manifold block includes a three reciprocating plungers, three valve cartridges, and three pockets for receiving the three valve cartridges.

6. A reciprocating fluid pump comprising:

(a) a first valve cartridge having a first step and seal configuration;

(b) a second valve cartridge having a second step and seal configuration;

(c) a manifold block defining a pocket into which either of the first and second valve can be received, the pocket extending between an inlet end and a discharge port, the manifold block defining a pilot pressure passage extending into the pocket between the inlet end and discharge port to enable sensing of whether the first valve cartridge or the second valve cartridge is installed in the pocket;

(d) a plunger box fitting against the manifold block; and (e) a reciprocating plunger mounted within the plunger box and in fluid communication with the manifold block pocket inlet end;

(f) wherein the pocket includes a plurality of bores including a first bore, a second bore, and a third bore, wherein the second bore is between the first and third bores, and wherein the pilot pressure passage extends into a first passageway through the second bore (g) wherein when the second valve cartridge is installed within the pocket, the discharge port and the pilot pressure passage are in fluid communication with each other.

7. The reciprocating fluid pump of claim 6, wherein when the first valve cartridge is installed within the pocket, pressurized fluid flow between the discharge port and the pilot pressure passage is blocked by the first step and seal configuration.

8. The reciprocating fluid pump of claim 6, wherein the first valve cartridge includes a first step and a first seal for engaging with the first bore, a second step and a second seal for engaging with the second bore, and a third step and a third seal for engaging with the third bore, wherein when the first valve cartridge is installed in the pocket, the third seal prevents pressurized fluid flow from passing between the discharge port and the pilot pressure passage.

9. The reciprocating fluid pump of claim 6, wherein the manifold block includes a plurality of pockets for receiving a plurality of the first and second valve cartridges.

10. The reciprocating fluid pump of claim 9, wherein the manifold block includes three pockets.

11. A manifold block and valve cartridge assembly comprising:

(a) a first valve cartridge having a first step and seal configuration;

(b) a second valve cartridge having a second step and seal configuration; and (c) a manifold block defining a pocket into which either of the first and second valve can be received, the pocket extending between an inlet end and a discharge port, the manifold block defining a pilot pressure passage extending into the pocket between the inlet end and discharge port to enable sensing of whether the first valve cartridge or the second valve cartridge is installed in the pocket;

(d) wherein the pocket includes a plurality of bores including a first bore, a second bore, and a third bore, wherein the second bore is between the first and third bores, and wherein the pilot pressure passage extends into a first passageway through the second bore;

(e) wherein when the second valve cartridge is installed within the pocket, the discharge port and the pilot pressure passage are in fluid communication with each other.

12. The manifold block and valve cartridge assembly of claim 11, wherein when the first valve cartridge is installed within the pocket, fluid communication between the discharge port and the pilot pressure passage is blocked by the first step and seal configuration.

13. The manifold block and valve cartridge assembly of claim 12, wherein the first valve cartridge includes a first step and a first seal for engaging with the first bore, a second step and a second seal for engaging with the second bore, and a third step and a third seal for engaging with the third bore, wherein when the first valve cartridge is installed in the pocket, the third seal prevents pressurized fluid flow from passing between the discharge port and the pilot pressure passage.

14. The manifold block and valve cartridge assembly of claim 11, wherein the manifold block includes a plurality of pockets for receiving a plurality of the first and second valve cartridges.

15. The manifold block and valve cartridge assembly of claim 14, wherein the manifold block includes three pockets.

* * * * *